US005207597A

United States Patent [19]

Kline et al.

[11] Patent Number: 5,207,597

[45] Date of Patent: May 4, 1993

[54] SHIELDED CONNECTOR WITH DUAL CANTILEVER PANEL GROUNDING BEAM

[75] Inventors: Richard S. Kline, Harrisburg; James Pritulsky, Hummelstown, both of Pa.

[73] Assignee: AMP Incorporated, Harrisburg, Pa.

[21] Appl. No.: 719,279

[22] Filed: Jun. 21, 1991

[51] Int. Cl.[5] ..... H01R 13/648

[52] U.S. Cl. ..... 439/607; 439/108

[58] Field of Search ..... 439/607-610, 439/676, 95, 108

[56] References Cited

U.S. PATENT DOCUMENTS

| | | | |
|---|---|---|---|
| 4,221,458 | 9/1980 | Hughes et al. | 339/126 R |
| 4,518,209 | 5/1985 | Negley | 439/609 |
| 4,637,669 | 1/1987 | Tajima | 339/14 R |
| 4,679,879 | 7/1987 | Triner et al. | 439/425 |
| 4,732,568 | 3/1988 | Hall | 439/676 |
| 4,738,638 | 4/1988 | Bogese, II | 439/610 |
| 4,842,554 | 6/1989 | Cosmos et al. | 439/609 |
| 4,842,555 | 6/1989 | Cosmos et al. | 439/609 |
| 4,906,201 | 3/1990 | Young et al. | 439/108 |
| 4,917,629 | 4/1990 | Matsuzaki et al. | 439/405 |
| 4,938,704 | 7/1990 | Fujiura | 439/95 |
| 4,952,170 | 8/1990 | Pritulsky | 439/509 |
| 5,035,652 | 7/1991 | Shibano | 439/610 |
| 5,083,945 | 1/1992 | Miskin et al. | 439/607 |
| 5,112,251 | 5/1992 | Cesar | 439/607 |

FOREIGN PATENT DOCUMENTS

| | | |
|---|---|---|
| 034497211 | 12/1989 | European Pat. Off. . |
| 0403371 | 12/1990 | European Pat. Off. . |

OTHER PUBLICATIONS

P. 24; AMP Catalog 83-711; Apr. 1984.

*Primary Examiner*—Larry I. Schwartz
*Assistant Examiner*—Hien D. Vu
*Attorney, Agent, or Firm*—David L. Smith; Anton P. Ness

[57] ABSTRACT

A circuit board mountable shielded data link electrical connector (2) comprises a generally rectangular insulating housing (4) and a metal shield (6). The shield (6) covers the upper side wall (14), opposite end walls (18), mating end (10) and the part of the lower side wall (16), of the housing (4). The upper side wall (54) of the shield (6) has an extension in the form of a rear wall flap (62) which can be bent down about notches (66) to cover the rearward wall (12) of the housing (4) when the housing (4) has been inserted into the shield (6), and secured in position by means of rearwardly projecting flanges (76) on the opposite end walls (56) of the shield (6). There project from opposite edges (68) of the upper side wall (54) of the shield (6) cantilever spring arms (82) having contact surfaces (92) proximate to the front wall (58) of the shield (6) for resiliently engaging a panel (P) when front wall (58) of the shield (6) is inserted through a hole (H) in the panel, so that the shield is grounded to the panel (P) which is of metal.

23 Claims, 8 Drawing Sheets

SHIELDED CONNECTOR WITH DUAL CANTILEVER PANEL GROUNDING BEAM

BACKGROUND OF THE INVENTION

This invention relates to a circuit board mountable shielded electrical receptacle connector, and in particular to a metal shield therefor having a dual cantilever grounding beam. The invention concerns improvements in the shielding of such connectors and in improvements in grounding the shield thereof to a panel. Since such connectors are used for the connection of electronic apparatus, for example computers and their peripherals, the signal contacts of such connectors should be well shielded and the shields thereof should be well grounded.

There is disclosed in U.S. Pat. No. 4,952,170 a shielded plug receptacle connector having a metal shield which surrounds only the forward end of the housing of the connector, which is of overall rectangular shape, the shield being grounded by contact with that of a shielded plug for mating with the receptacle connector. U.S. Pat. No. 4,842,555 discloses a shielded circular DIN receptacle connector having an overall rectangular shaped housing provided with a rectangular metal shield having an upper side wall covering an upper side wall of the housing, opposite end walls covering opposite end walls of the housing, a front wall covering a front wall of the housing and having a circular plug access opening, and a rudimentary bottom wall covering part of a lower side wall of the housing near the front wall thereof. The shield is, however, open at its rear end. The shield is grounded by means of mounting feet for soldering to ground traces on a circuit board on which the connector is mounted. There is disclosed in U.S. Pat. No. 4,637,669, a rectangular shield for a rectangular connector housing. The shield covers an upper side wall of the housing and opposed end walls thereof. The shield is formed with an upstanding lug for fastening to the chassis of an electronic apparatus, and with mounting feet for soldering to ground traces on a printed circuit board.

SUMMARY OF THE INVENTION

According to one aspect of the invention, a shielded electrical connector comprises a substantially rectangular insulating housing having a mating end, that is to say a front end, a rearward end, upper and lower side walls and oppositely facing end walls connecting said mating and rearward ends, the housing defining an internal cavity opening into said mating end for receiving a mating electrical connector. Electrical contacts secured in the housing have mating portions projecting into the cavity and connecting portions projecting from the lower side wall of the housing. The housing is provided with a one-piece metal shield having an upper side wall covering the upper side wall of the housing, opposite end walls each covering a respective end wall of the housing, a front wall covering the mating face of the housing and having an opening therethrough providing access to the cavity for the mating connector, a lower side wall projecting beneath part of the lower side wall of the housing, and a rear wall flap hingedly connected to the rear end of the upper side wall of the shield and covering the rearward end of the housing.

The housing is, therefore completely shielded, excepting for that part of the lower end wall through which the connecting portions of the contacts project for insertion through holes in a printed circuit board and which part of said lower wall is to engage the circuit board, by way, for example of stand-off projections on said lower end wall of the housing.

Because of the presence of the lower side wall of the shield and also the presence of means projecting into the shield from the front wall of the shield for contacting shielding of the mating connector, the housing would not be insertable into the shield if it were provided with a fixed rear wall. According to the invention, therefore, the rear wall is in the form of a hinged flap so that in a raised position of the flap, the housing can be inserted into the shield, the flap being subsequently folded down into a final position covering the rear wall of the housing. As described below means are provided for securing the flap in said final position. The flap may be, in its initial position in the form of a coplanar rear extension of the upper side wall of the shield, notches being provided therein in order to facilitate the folding down of the flap.

In use, the connector may be mounted on a circuit board with the front wall of the shield protruding slightly from a front edge of the board, said front wall being inserted through a hole in a metal panel of an electronic apparatus so that the mating connector can be inserted into the cavity in the connector housing to connect the apparatus to a peripheral apparatus. In this case it is desirable that the shield should be grounded to the panel without the need for fastening the shield to the panel.

According to another aspect of the invention, a one-piece metal shield for a surface mounted, substantially rectangular plug receptacle connector housing, comprises an upper side wall, a front wall adjacent thereto depending from a forward end of the upper side wall and having a plug receiving opening therethrough, a pair of opposed end walls each adjacent to the upper side wall and to the front wall and being bridged by the upper side wall, and at least one dual cantilever panel grounding beam connected to a respective lateral edge of the upper side wall. The dual cantilever panel grounding beam has a first portion extending rearwardly of the shield and a second portion connected to the first portion by a bight and extending forwardly obliquely away from the first portion, the second portion of the at least one dual cantilever panel grounding beam terminating in a contact surface proximate to the front wall of the shield.

When the connector is assembled to the metal panel, or equivalent, as described above the contact surfaces of the dual cantilever beam resiliently engages the panel so as to ground the shield of the connector thereto. The at least one dual cantilever beam is configured such that the contact surfaces of the arms engage the panel with a predetermined force with substantial tolerance in location between the final position of the connector and the panel.

DESCRIPTION OF THE PREFERRED EMBODIMENT

Figure 1:
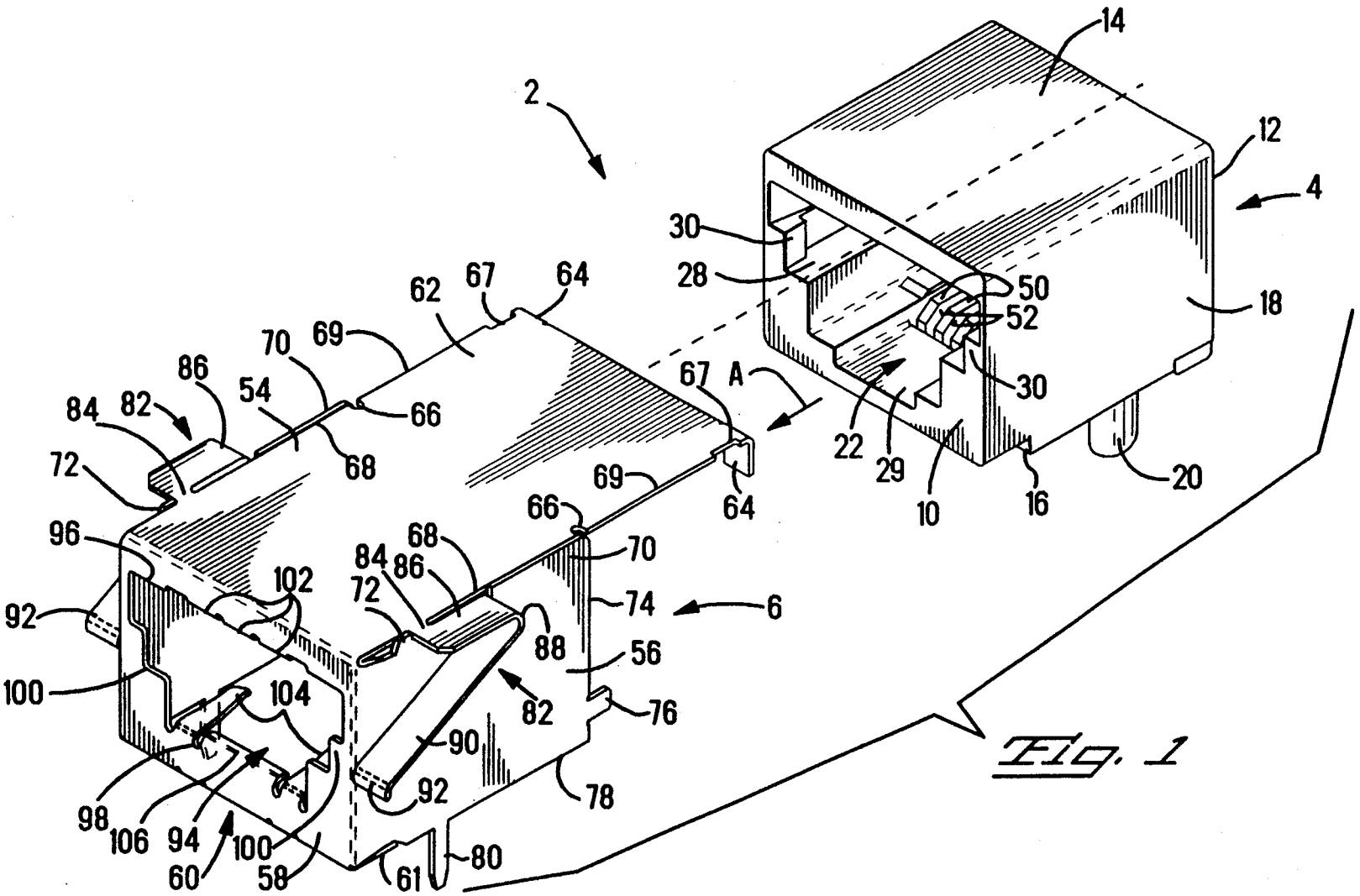
FIG. 1 is an isometric view of a receptacle connector according to a first embodiment of the invention, showing the shield of the connector exploded therefrom with a rear wall flap of the shield in an initial raised position wherein the shield has at least one dual cantilever panel grounding beam integral therewith and extending therefrom.

Reference Will now be made from FIGS. 1 to 3 and 6. A board mountable shielded electrical connector 2 which comprises an insulating housing 4, a sheet metal shield 6, and four electrical contacts 8 in the housing 4. In the preferred embodiment the connector is a receptacle connector.

The housing 4, which is of substantially rectangular shape, and which has been molded in one piece from a suitable synthetic resin, is of the general type disclosed in U.S. Pat. No. 4,221,458 and U.S. Pat. No. 4,952,170, for example, the disclosure of which is hereby incorporated herein by reference. The housing 4 has a mating end 10, a rearward end 12, upper and lower external housing side walls 14 and 16, respectively, and oppositely facing end walls 18. For securing the connector 2 to a printed circuit board, as will be described below, the housing 4 has known board locks 20 depending from the lower side wall 16. A plug receiving cavity 22 extends inwardly from the mating end 10 for receiving a mating, shielded data-link plug (not shown) according, for example, to U.S. Pat. No. 4,952,170, cited above. The cavity 22 has upper and lower walls 24 and 26, respectively, and opposed end walls 28. A central longitudinal recess 29 opens into the mating face 10. The end walls 28 are formed with shoulders 30 for engagement by latch arms of the plug to retain it in the cavity 22. The contacts 8, which are cantilever spring receptacle contacts, are arranged in side-by-side relationship in a row which extends between the end walls 28. Each contact 8 has a post portion 32 which depends from the housing wall 16, for soldering to an electrically conductive trace on said printed circuit board. Connected to the post portion 32, each contact 8 has an intermediate portion 34 which is received in a respective recess 36 extending inwardly from the wall 16, and a contact spring portion 38 which extends obliquely into the cavity 22, with a reverse bend 40 between the portions 34 and 38, recessed from the mating end 10. The free end 42 of each contact spring 38 extends into a respective recess 43 defined by spaced apart barrier walls 44 at the inner end of the cavity 22. The recesses 43 serve to position the contact spring portions 38 and to prevent them from engaging each other. Keys 46 are provided on the wall 24 for reception in keyways in said plug. There project from the lower wall 16, stand-off projections 48 for engaging the printed circuit board. Barrier walls 50 define recesses 52 each communicating with a respective recess 36 and confining the respective reverse bends 40 and the adjacent parts of the contact spring portions 38.

Figure 2:
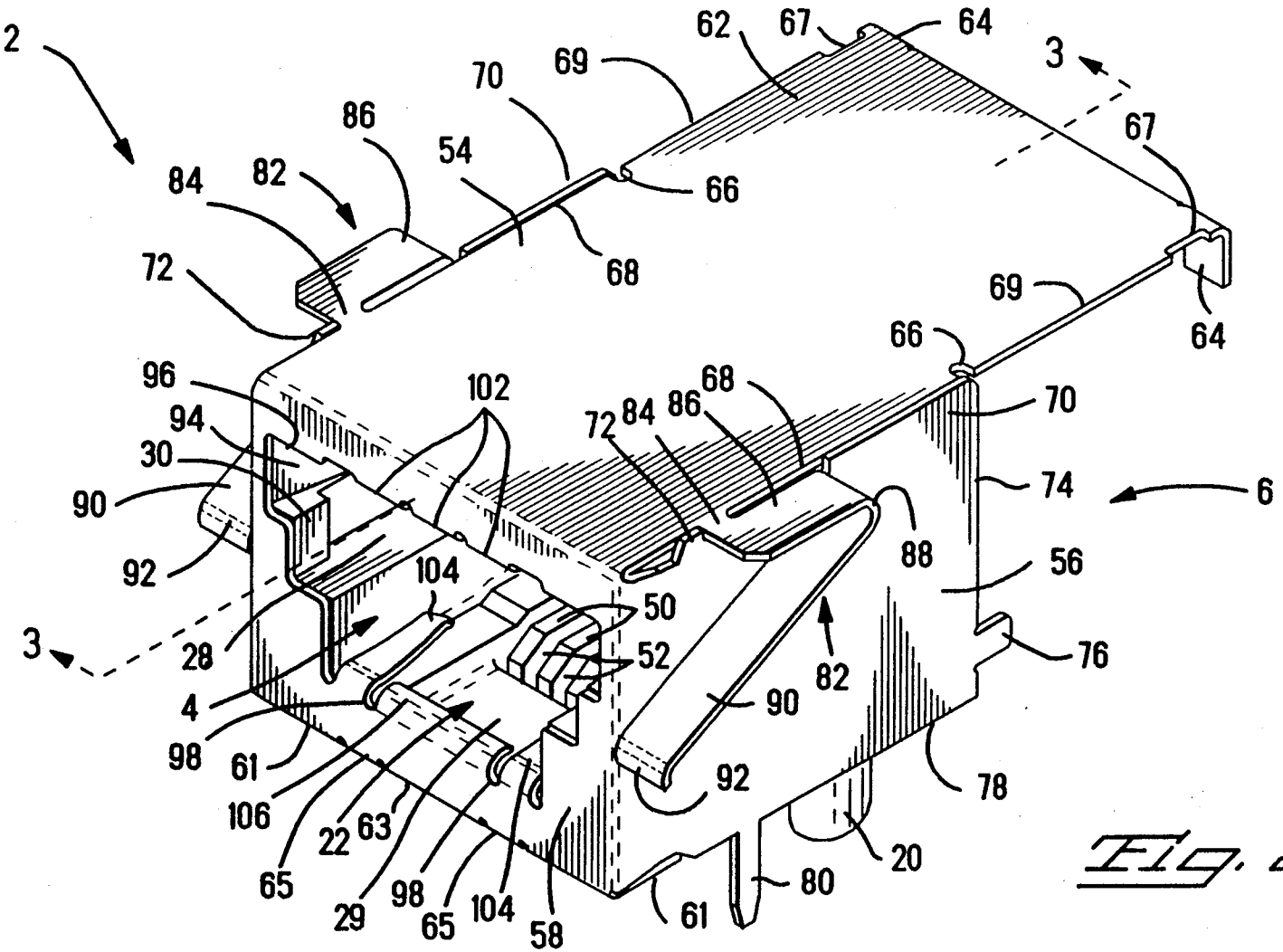
FIG. 2 is an isometric view showing the connector received in the shield.
Figure 3:
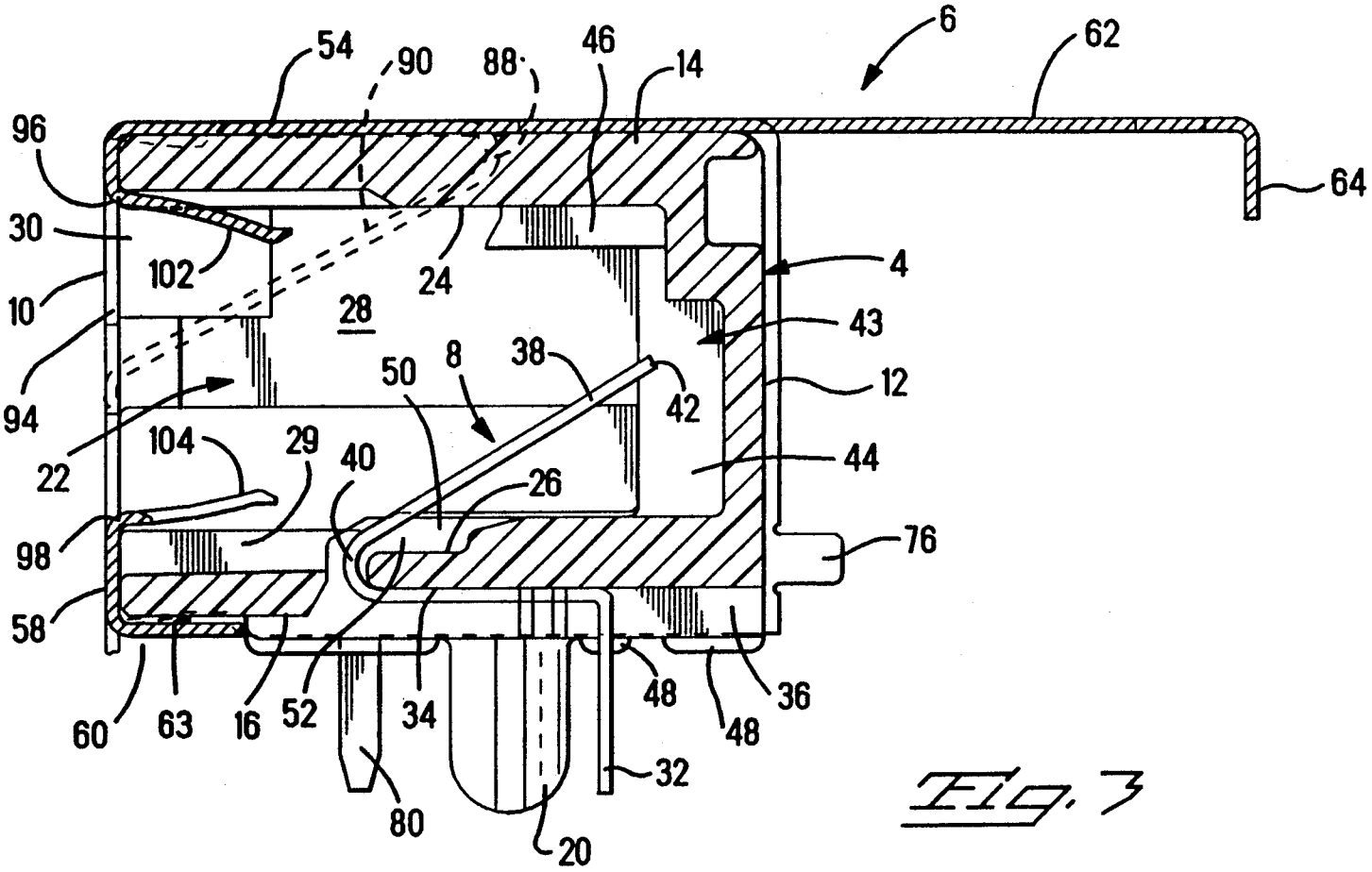
FIG. 3 is a view taken on the lines 3—3 of FIG. 2.

The shield 6, which is of substantially rectangular shape and which has been stamped and formed from a single piece of sheet metal stock, as described below with reference to FIG. 7, comprises an upper side wall 54, opposed end walls 56, a front wall 58, depending from the wall 54, and a rudimentary lower side wall 60 comprising outer wall portions 61, an inner wall portion 63 and narrower intermediate wall portions 65 these wall portions being separated by slots and projecting from the front wall 58. There extends, as shown in FIGS. 1 to 3, from the rear end of the upper side wall 54, and in coplanar relationship therewith, a rectangular rear wall provided by a flap 62, said flap being shown in the Figures under discussion, in an initial raised position. A flange 64 depends at right angles from each end of the rear edge of the flap 62. Each edge 69 of the flap 62 is formed with a recess 67 proximate to the respective flange 64. A notch 66 is formed in each lateral edge 68 of the wall 54 where it adjoins the flap 62 to facilitate folding the flap 62 down at right angles to the wall 54 as will be described below. The wall 54 is formed integrally, only with the front wall 58 and with the flap 62. Each lateral edge 68 of the wall 54 lies between elongate rear flanges 70 of the walls 56 and between shorter forward flanges 72 of the walls 56, the flanges 70 and 72 serving to confine the wall 54 laterally. From the rear edge 74 of each wall 56 there projects, in the plane thereof, a rear wall fastening flange 76, proximate to the lower edge 78 of the wall 56. There depends from each lower edge 78 near its forward end, a mounting foot 80 in the plane of the respective wall 56.

A double cantilever spring grounding arm 82 is connected to at least one edge 68 of the wall 54 by way of a narrow neck 84 coplanar with the wall 54 and which abuts the respective flange 72 and rests on the upper edge of the respective wall 56. In a preferred embodiment, an arm 82 extends from each edge 68. Each arm 82 has an upper rearwardly extending flat, rectilinear portion 86 coplanar with the neck 84 and thus with the wall 54 and which is connected by way of a bight 88, to a reversely that is to say forwardly extending flat, rectilinear portion 90 of greater, and in the preferred embodiment, substantially twice the length of the portion 86 and which terminates at its free end in a rounded, forwardly convex contact surface 92 proximate to the front wall 58. Each arm portion 90 projects from the respective bight 88 at an angle of approximately 40° with respect to the respective arm portion 86. Each arm portion 86 and 90 and the bight 88 in the preferred embodiment are of equal constant width and thickness but the invention is not limited thereto. The wall 58 defines a plug access opening 94, having an upper edge 96, and a lower edge 98 connected by lateral edges 100. A row of cantilever spring beams 102 projects inwardly and rearwardly of the shield 6, from the edge 96, for engaging an upper external shield portion of said plug, a pair of similar cantilever spring beams 104 projecting from the edge 98 for engaging a lower external shield portion of said plug. Between the beams 104, an inwardly curved plug guiding flange 106 projects from the edge 98.

Figure 4:
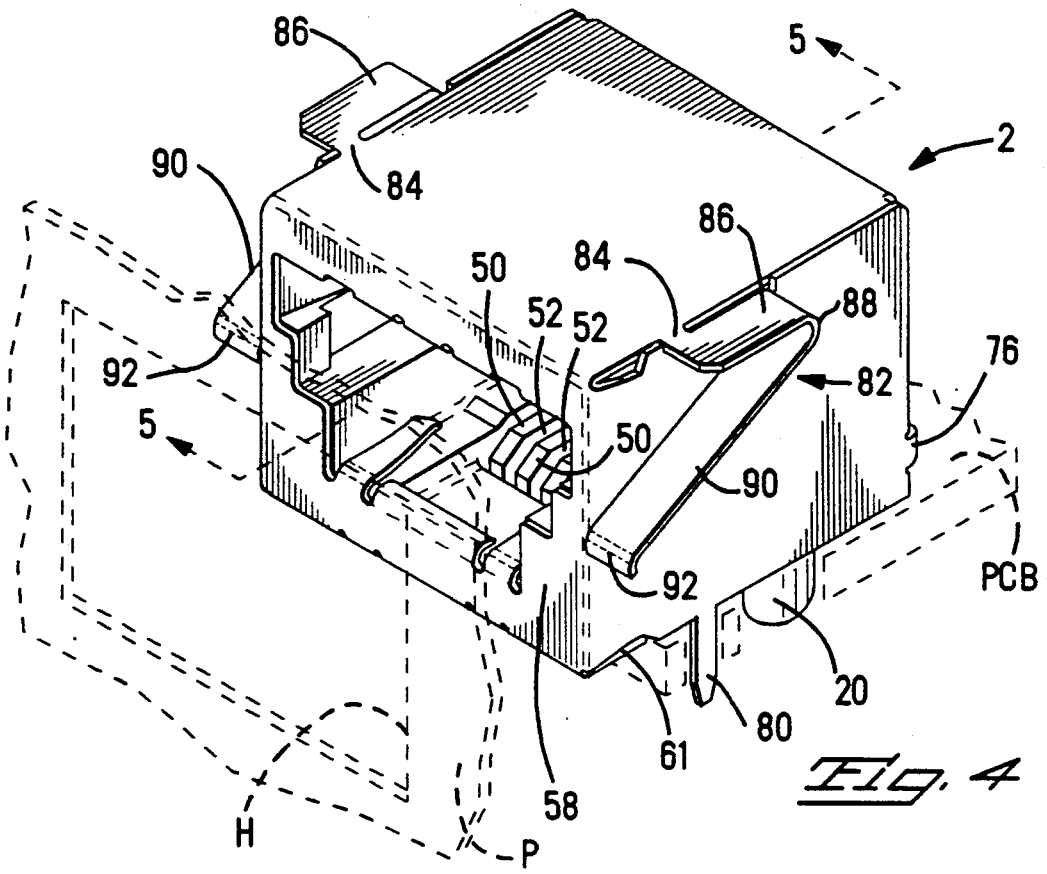
FIG. 4 is an isometric view of the connector with said rear wall flap of the shield in a folded down final position, and with the connector mounted on a printed circuit board and positioned behind a metal panel, the circuit board and the panel being shown in broken lines.
Figure 5:
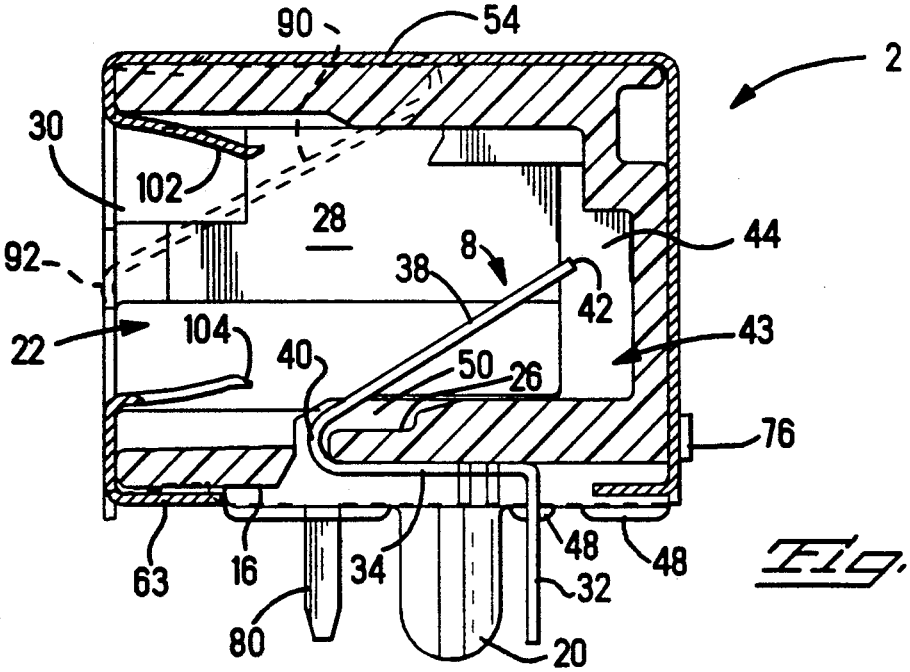
FIG. 5 is a view of the connector taken on the lines 5—5 of FIG. 4, the circuit board and the panel not being shown.
Figure 6:
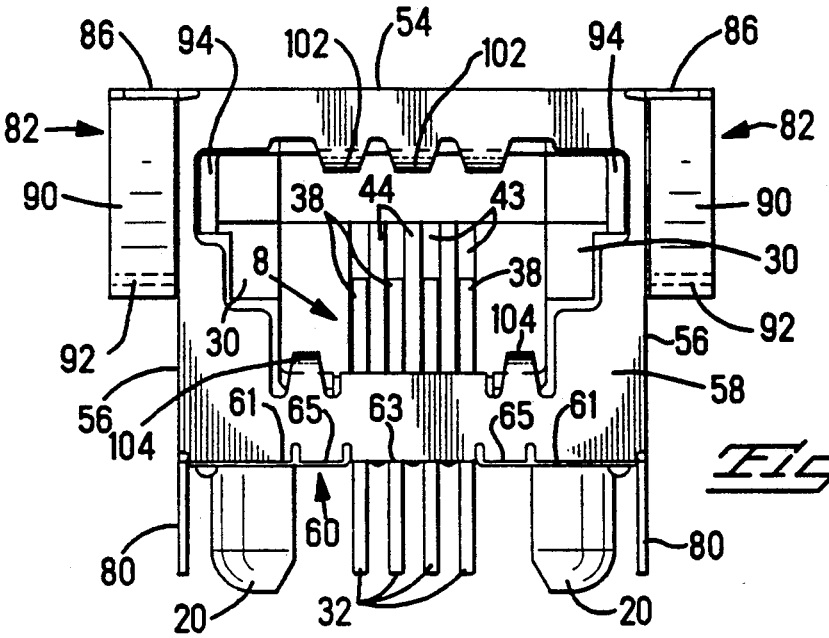
FIG. 6 is a front view of the connector.

The shield 6 is assembled to the housing 4 by inserting the housing 4 thereinto by way of the open rear of the shield 6, as indicated by the arrow A in FIG. 1, until the mating end 10 of the housing 4 bottoms against the front wall 58 of the shield 6, as best seen in FIG. 3, the flange 106 being received in the recess 29 of the housing 4 and the flap 62 projecting from the rearward end 12 of the housing 4. Be it noted that the walls 14 and 18 of the housing 4 are completely covered by the walls 54 and 56, respectively, of the shield 6, the mating end 10 of the housing 4 being completely covered by the shield wall 58, the edges 100 of which are profiled to cover the sides of the mating end 10. The wall 60 covers the lower wall 16 of the housing 4 in the vicinity of its mating face 10. The shield 6 having been so assembled to the housing 4, the flap 62 is bent down at right angles to the shield wall 54 into a final lowered, operative position, as shown in FIGS. 4 and 5 so that the rearward end 12 of the housing 4 is covered by the flap 62 which now constitutes the rear wall of the shield 6. In order to secure the flap 62 in said final position, the flanges 76 of the shield 6 are bent inwardly to engage in the notches 67 thereof, the flanges 64 engaging in the rear ends of respective recesses 36 of the housing 4; whereby the housing 4 is fixedly secured in the shield 6. The mounting feet 80 of the shield 6 depend below the wall 16 of the housing 4.

Figure 8:
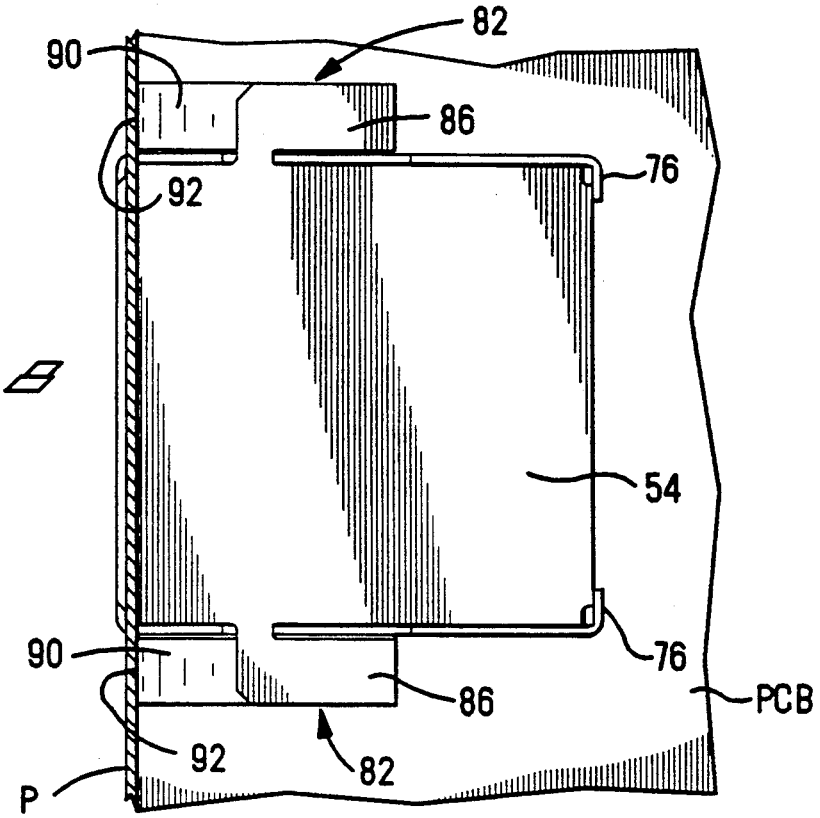
FIG. 8 is a top plan view of the connector when assembled to the circuit board and the panel, the panel being shown in section.
Figure 9:
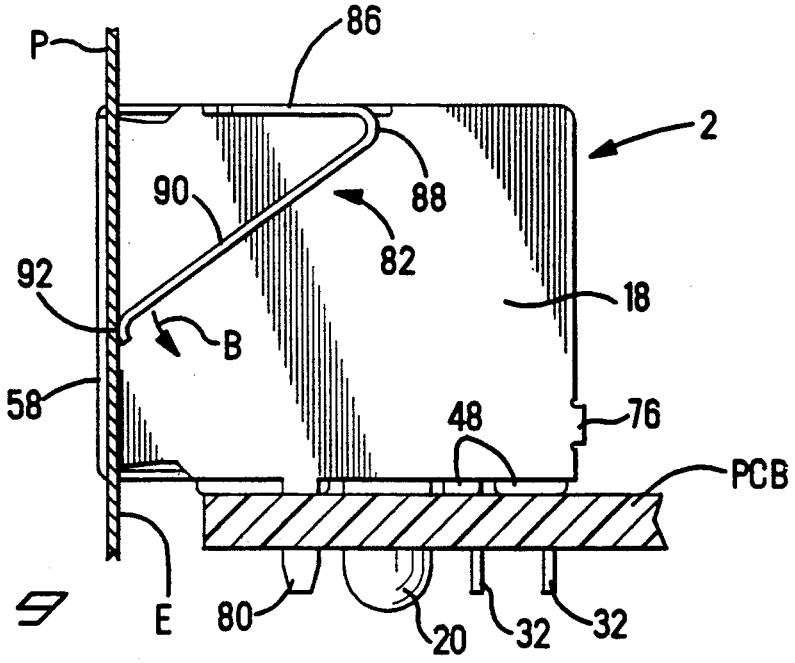
FIG. 9 is a side view of FIG. 8, the printed circuit board being shown in section.

In use, as shown in FIGS. 4, 8 and 9, the connector 2 with the shield 6 secured to the housing 4 as described above, is mounted on a circuit board PCB, which is shown in fragmentary form, with the board locks 20, the mounting feet 80 and the post portions 32, extending through respective holes in the board PCB. The mounting feet 80 are soldered to ground traces (not shown) on the board PCB, the post portions 32 being soldered to signal traces (not shown) on the board PCB. The connector 2 is disposed on the board PCB so that the wall 58 of the shield 6 lies just beyond the forward edge E of the board PCB.

At its site for use, the board PCB is positioned with its forward edge E against the rear face of a metal panel P, which may be, for example, an external panel of an electronic apparatus, for example a computer, with the wall 58 of the shield 6 protruding through a rectangular hole H in the panel P, in order to enable the connector 2 to receive a shielded data-link plug to connect the apparatus to a peripheral electronic apparatus, for example. The double cantilever arms 82 serve to engage the rear face of the panel P so as to ground the shield 6 thereto.

Figure 10:
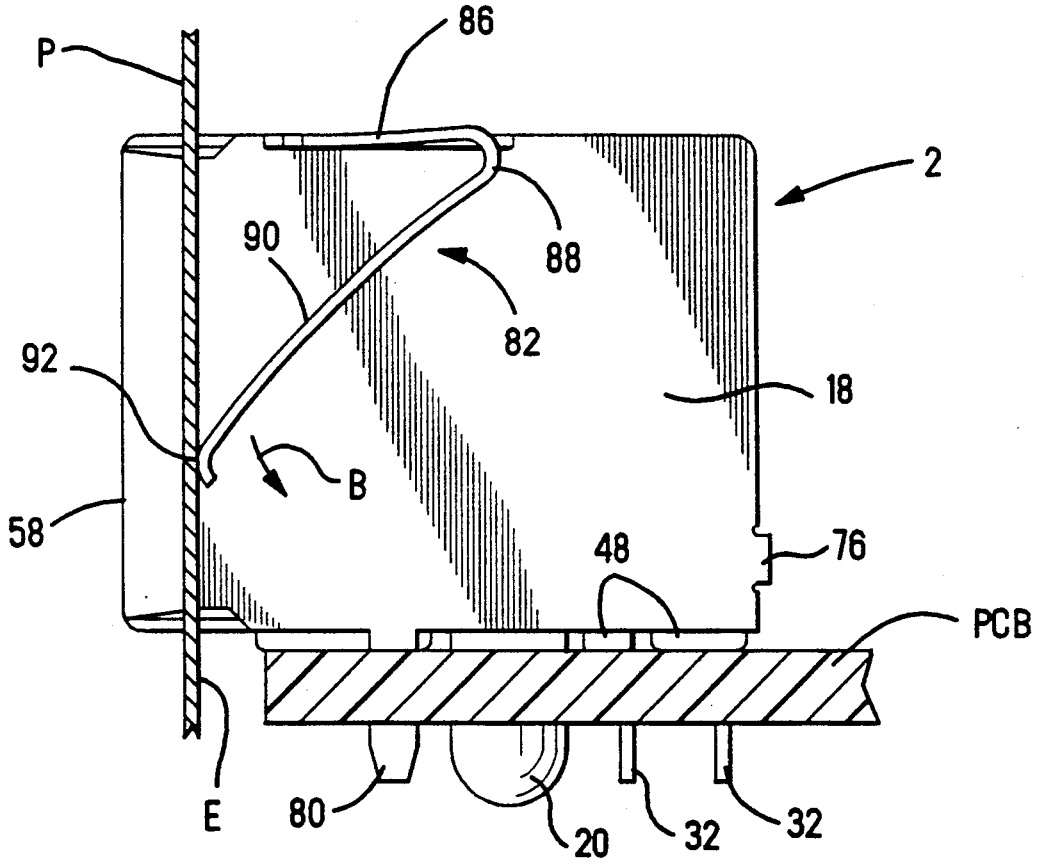
FIG. 10 is a side view similar to FIG. 9 with the connector positioned further into the panel.

As the front wall 58 of the shield 6 is aligned with and inserted into the panel aperture or hole H, the rounded contact surface 92 of the portion 90 of each arm 82 engages the rear face of the panel P. Continued movement of the connector into hole H causes portion 90 to deflect or rotate in a counterclockwise direction as indicated by arrow B in FIG. 9, whereby the contact surface 92 is slid downwardly to a small extent along the rear face of the panel P. When portion 90 is deflected, stresses build up in bight 88. Bight 88 opens slightly as portion 90 rotates counterclockwise, as shown in FIG. 9. Continued movement of the connector into hole H further deflects portion 90 and further increases the stress in the bight, but before the stresses reach the yield limit of the shield material, the further stress is transferred to arm portion 86 which causes arm portion 86 to flex. Typically arm portion 86 will deflect upwardly with the free end portion proximate bight 88 bowing out of the plane of neck 84 while the secured end portion proximate neck 84 remains substantially in the plane of neck 84 as shown in FIG. 10.

This dual cantilever action limits stress in bight 88 to prevent a permanent set therein. This dual cantilever beam action also permits a greater range for surface 92 to engage the panel while maximizing the normal force between surface 92 and the panel. The greater range for surface 92 to engage the panel could provide a greater tolerance in the relative positioning of the connector and the panel or could accommodate various panel thicknesses.

Each arm 82 is so dimensioned that its contact surface 92 engages the rear face of the panel P with a predetermined force with substantial tolerance in location between the final position of the connector 2 and the panel P of plus or minus 0.040". The slight downward movement of each contact surface 92 serves to wipe the panel surface engaged free of any metallic oxide or other fouling, that may be on the rear surface of panel P, so that excellent mechanical and hence electrical contact is achieved between the arm 82 and thus the shield 6, and the panel P to provide a ground path therebetween.

Figure 7:
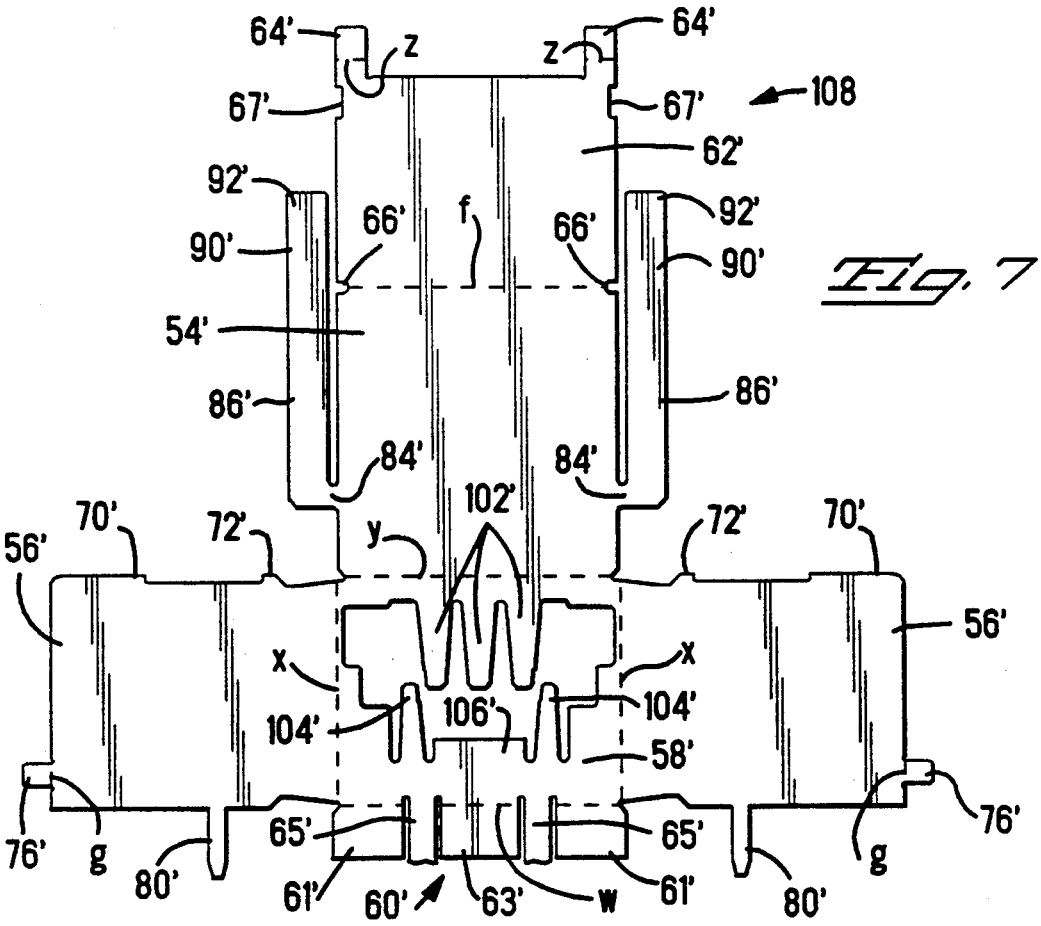
FIG. 7 is a plan view of a sheet metal blank from which the shield is to be formed.

FIG. 7 shows a stamped sheet metal blank 108 which is to be formed to provide the shield 6. The parts of the blank 108 bear the same reference numerals as the parts of the shield 6 which have been described above, but with the addition of a prime symbol. In order to form the shield 6, after being the parts 86' and 90' of the blank to provide the arms 62, the parts 56' of the blank 108 are folded down towards each other at right angles to the plane of the part 58' of the blank 108, along fold lines x, the part 58' is folded down along fold lines y, guided by the parts 70' and 72', so that the parts 84' lie adjacent to the part 72', and the parts 61', 63' and 65' are folded back under the part 56' along fold line w. The parts 64' are folded down at right angles to the part 62' along fold lines z. When the shield has been assembled to the housing 4, the part 62' is folded down along fold line f so as to be perpendicular to the part 54', in the manner described above with reference to FIGS. 4 and 5, and the parts 76' are folded in along fold lines g to secure the part 62' in its final position.

Figure 11:
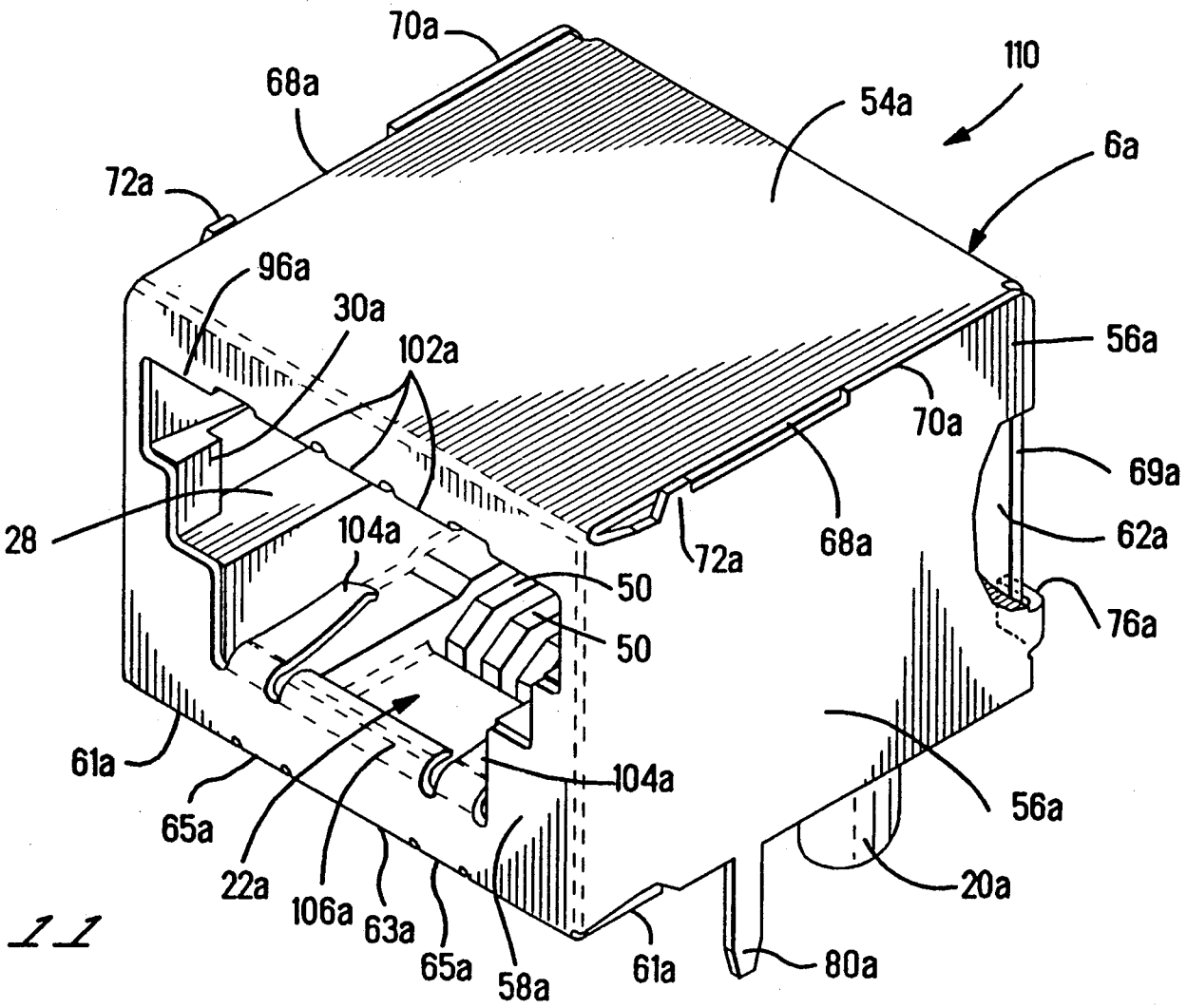
FIG. 11 is an isometric view of a shielded datalink electrical receptacle connector according to a second embodiment of the invention, with a portion broken away.

According to the second embodiment of the invention which is shown in FIG. 11, in which the parts described above with references to FIGS. 1 to 6 bear the same reference numerals as in those Figures, but with the addition of the suffix letter a, the arms 82 of a connector 110, which is otherwise the same as the connector 2, are omitted. In this case the shield 6*a*, can be grounded only by way of its mounting feet 80*a*.

What is claimed is:

1. A shielded electrical connector, comprising:

an insulating housing having a mating end, a rearward end, upper and lower side walls, and oppositely facing end walls, connecting said mating end with said rearward end, the housing defining an internal cavity opening onto said mating end for receiving a mating electrical connector;

electrical contacts secured in said housing and having mating portions projecting into said cavity and connecting portions projecting from said lower side walls; and a one piece metal shield having an upper side wall covering the upper side wall of the housing, opposite end walls each covering a respective end wall of the housing, a front wall covering the mating face of said housing and having an opening therethrough providing access to said cavity for said mating connector, a lower side wall projecting beneath part of the lower side wall of the housing, and a rear wall flap hingedly connected to the rear end of the upper side wall of the shield and covering the rearward end of the housing, said shield including a pair of cantilever arms each connected to a respective lateral edge of the upper side wall and each having a contact surface proximate to the front wall of the shield, and each said cantilever arm has a first rectilinear portion connected by way of a neck to the lateral edge of the respective upper side wall of the shield and extending rearwardly thereof alongside said lateral edge, and a second rectilinear portion connected to said first portion by way of a bight and extending forwardly of the shield and beneath said first portion, the contact surface of the arm being formed on a free end of said second portion.

2. A connector as recited in claim 1, wherein flange means project from said end walls of the shield for securing the rear wall flap in covering relationship with the rear end of the housing.

3. A connector as recited in claim 1, wherein the upper side wall of the shield is formed at its rear end, with notches opening into opposite edges thereof to facilitate hinging movement of said flap from an initial position in which the flap is coplanar with the upper side wall of the shield to a final position in which said flap covers the rear end of the housing.

4. A connector as recited in claim 1, wherein the lower side wall of the shield projects from the front wall thereof and covers the lower side wall of the housing in the vicinity of the mating face.

5. A connector as recited in claim 1, wherein the upper side wall of the shield is formed integrally with the front wall thereof and rests upon upper edges of the end walls of the shield, flanges surmounting such upper edges laterally confining the upper side wall of the shield.

6. A connector as recited in claim 1, comprising a pair of cantilever arms each connected to a respective lateral edge,,of the upper side wall of the shield and each having a contact surface proximate to the front wall of the shield.

7. A connector as recited in claim 1, wherein said first and second portions of each arm planar and of equal, constant cross sectional area, said second portion of each arm extending obliquely away from the first portion thereof.

8. A connector as recited in claim 7, wherein said first and second portions of each arm define an angle of approximately 40° therebetween.

9. A one-piece metal shield for a circuit board mountable, substantially rectangular plug receptacle connector housing, the shield comprising an upper side wall, a front wall adjacent thereto depending from a forward end of the upper side wall and having a plug receiving opening therethrough, a pair of opposed end walls each adjacent to the upper side wall and to the front wall and being bridged by the upper side wall, and a pair of cantilever spring arms each connected to a respective lateral edge of the upper side wall and having a first portion extending rearwardly of the shield and a second portion connected to the first portion by a bight and extending obliquely away from the first portion forwardly of the shield, the second portion of each cantilever arm terminating in a contact surface proximate to the front wall of the, shield.

10. A shield as recited in claim 9, wherein the first and second portions of each cantilever arm of planar and are of equal cross sectional area, the second portion of each arm being substantially twice as long as the first portion thereof.

11. A shield as recited in claim 10, wherein the first and second portions of each arm define between them, an angle of substantially 40°.

12. A shield as recited in claim 9 wherein said shield includes a rear flap hingedly connected to the rear end of the upper side wall for movement with respect thereto from an initial position of alignment with said upper side wall to a final position bridging the rear ends of said end walls.

13. A shield as recited in claim 12, comprising first flanges projecting normally from the rear end of the rear wall flap for engagement beneath said end walls in said final position of the rear end flap and flanges projecting from the rear edges of said end walls for bending against the rear end flap to retain it in its final position.

14. A shield as recited in claim 12, wherein lateral edges of the upper side wall are formed with notches to facilitate hinging movement of the rear wall flap.

15. A shield as recited in claim 12, comprising a rudimentary lower side wall projecting from the front wall rearwardly of the shield.

16. An electrical connector having a portion thereof receivable in an aperture in a panel, the connector comprising:

an insulating housing defining a mating face and having at least one contact secured therein, said housing including side walls extending orthogonally from said mating face;

a shield including at least one side wall disposed in a plane adjacent a respective said housing side wall, said shield surrounding at least a portion of said housing, said shield having a dual cantilever panel engaging beam extending therefrom, said beam having a first portion and a second portion interconnected by a bight, said first portion joined at a first end to a lateral edge of said at least one side wall of said shield by a neck extending laterally from said at least one side wall proximate said mating face and extending from said first end parallel to said lateral edge and spaced therefrom and away from said mating face a selected distance to a second end proximate said bight such that said first portion is initially disposed in the plane of said at least one side wall and upon mounting to said panel is deflectable out of said plane, said second portion extending from said bight to a free end proximate said mating face and initially extending therebeyond, whereby when a portion of the connector is received in an aperture in a panel the free end of said second portion of said dual cantilever beam engages the panel to establish a ground path between the shield and panel, said second portion is deflectable about said bight and said first portion is deflectable about said neck thereby relieving stress on said bight.

17. An electrical connector as recited in claim 16 wherein said dual cantilever panel engaging beam is interconnected with said shield at a lateral edge thereof.

18. An electrical connector as recited in claim 16 further comprising a second dual cantilever panel engaging beam.

19. An electrical connector as recited in claim 16 wherein a free end of said second portion comprises a curved panel engaging surface.

20. An electrical connector as recited in claim 16 wherein said second portion extends from said bight toward the mounting face.

21. An electrical connector as recited in claim 16 wherein the second end of a first portion extends away from said mating face.

22. An electrical connector as recited in claim 21 wherein said second portion extends from said bight toward the mounting face.

23. An electrical connector as recited in claim 16 wherein said at least one contact is adapted to be soldered to a respective land on a circuit board.

* * * * *